United States Patent [19]

Koike

[11] Patent Number: 4,562,801

[45] Date of Patent: Jan. 7, 1986

[54] ENGINE CONTROL SYSTEM FOR MARINE PROPULSION DEVICE

[75] Inventor: Takashi Koike, Hamamatsu, Japan

[73] Assignee: Sanshin Kogyo Kabushiki Kaisha, Japan

[21] Appl. No.: 634,982

[22] Filed: Jul. 27, 1984

[30] Foreign Application Priority Data

Jul. 28, 1983 [JP] Japan ..... 58-136830
Oct. 15, 1983 [JP] Japan ..... 58-193193

[51] Int. Cl.[4] ..... F02B 77/08

[52] U.S. Cl. ..... 123/196 S; 123/198 D; 123/198 DC

[58] Field of Search ..... 123/196 S, 198 D, 198 DB, 123/198 DC

[56] References Cited

U.S. PATENT DOCUMENTS

| | | | |
|---|---|---|---|
| 3,196,389 | 7/1965 | Heidner | 123/198 D |
| 3,602,207 | 8/1971 | Kilmer | 123/196 S |
| 4,019,489 | 4/1977 | Cartmill | 123/198 D |
| 4,034,732 | 7/1977 | Van Burkleo | 123/198 DC |
| 4,147,151 | 4/1979 | Wright | 123/196 S |
| 4,171,687 | 10/1979 | Coventry | 123/198 DC |
| 4,292,939 | 10/1981 | Coates et al. | 123/198 D |
| 4,445,470 | 5/1984 | Chmielewski | 123/196 S |
| 4,453,512 | 6/1984 | Sakae et al. | 123/196 S |
| 4,459,951 | 7/1984 | Tobinaga et al. | 123/198 DC |

FOREIGN PATENT DOCUMENTS

| | | |
|---|---|---|
| 47-8825 | 4/1972 | Japan . |
| 47-15079 | 5/1972 | Japan . |
| 47-15528 | 6/1972 | Japan . |
| 48-15104 | 4/1973 | Japan . |
| 55-53297 | 4/1980 | Japan . |

*Primary Examiner*—Ira S. Lazarus
*Attorney, Agent, or Firm*—Ernest A. Beutler, Jr.

[57] ABSTRACT

A protection system for a two-cycle outboard motor engine having a separate lubricant storage tank. The protection system generally includes a sensing device associated with the lubricant storage tank for detecting a low lubricant level condition, a first circuit for producing a speed reduction signal in response to the detection of this condition, a second circuit for gradually reducing the speed of the engine in response to the speed reduction signal even though the engine throttle control may be set for a higher speed, and a switch for manually terminating this speed control. The first circuit includes a controlled conduction device for maintaining the presence of the speed reduction signal after the low lubricant level condition is no longer present until the switch is actuated.

20 Claims, 5 Drawing Figures

ENGINE CONTROL SYSTEM FOR MARINE PROPULSION DEVICE

BACKGROUND OF THE INVENTION

This invention relates generally to an engine control system for a marine propulsion device, and particularly to an engine control system which is adapted to protect a two-cycle outboard motor.

With two-cycle internal combustion engines, it has been the general practice to lubricate the engine by mixing lubricating oil with the fuel mixture. Although such arrangements offer extreme simplicity, the mixing of lubricating oil with the fuel can be troublesome to the user of the engine. In addition, the requirement for mixing lubricant with the fuel and lubricating the components of the engine with the fuel/air mixture does not always insure the adequate amount of lubrication to the various components to be lubricated under all running conditions. In order to obviate some of these difficulties, it has been proposed to provide a lubricating system where the lubricant is contained within a separate tank from the fuel and is supplied to the engine during its running. Such arrangements have a number of advantages. One such separate lubrication system is described in the commonly assigned co-pending U.S. patent application Ser. No. 610,847, entitled "Separate Lubricating System For Marine Propulsion Device", which is hereby incorporated by reference.

When the engine in question constitutes the power unit of an outboard motor, however, the provision of such separate lubricating systems can give rise to certain practical difficulties. For example, when the lubricant in the storage tank or reservoir reaches a low level, it is desirable to run the outboard motor at a low speed which will conserve the supply of the lubricant and prevent the engine from running at a high speed when the supply of lubricant is depleted. Thus, it would be desirable to provide a protection system for the engine which will regulate the speed of the engine so as to reduce the engine speed to a predetermined low level. Such a protection system would override the particular engine throttle setting which may be set for a higher engine speed. It would also be desirable for the protection system to provide a perceptible output which would indicate to the operator that the lubricant in the storage tank should be replenished. However, since many marine propulsion devices have throttles which can be set in a fixed position without being operated by hand, it is important for the protection system to avoid any unintentional increase in engine speed which could result as the lubricant storage tank is being replenished.

It is, therefore, a principal object of this invention to provide an improved engine control system which will protect a two-cycle outboard motor.

It is another object of this invention to provide a protection system for an internal combustion engine which is capable of controlling an operating parameter of the engine in response to a predetermined condition until such time as this control is intentionally terminated.

It is a more specific object of the present invention to provide a protection system for an internal combustion engine which will control the speed of the engine so as to cause a reduction in the engine speed when the lubricant in the storage tank reaches a predetermined level, and maintain the engine speed at a predetermined low level until such time as this control is intentionally terminated.

It is a further object of this invention to provide a protection system which is also capable of controlling the speed of the engine so as to reduce the engine speed in response to an overheat condition.

It is an additional object of this invention to provide a protection system for an internal combustion system which is also capable of providing a plurality of perceptible outputs indicative of the lubricant level and the presence/absence of an overheat condition.

It is yet another object of this invention to provide a protection system for an outboard motor which will maintain an engine control function in response to a low lubricant level, even after the lubricant supply is replenished, until such time as this control is positively disengaged by the operator.

It is yet a further object of this invention to provide a protection system for an internal combustion engine which may be readily and inexpensively interfaced to a capacitive discharge ignition system of the engine to automatically initiate control of the speed and manually release such control over the engine speed.

SUMMARY OF THE INVENTION

To achieve the foregoing objects, the present invention provides a control system for an internal combustion engine which generally comprises means for detecting a predetermined condition, means for controlling a predetermined operating parameter of the engine in response to the detection of this predetermined condition, means for manually terminating this control, and means for maintaining this control after the predetermined condition has ceased until this control is manually terminated. In accordance with one feature of the present invention, the predetermined condition is a low lubricant level condition. In accordance with another feature of the present invention, the predetermined operating parameter is the speed of the engine which is gradually reduced to a predetermined low level.

In accordance with a further feature of the present invention, the control system includes means for producing perceptible outputs which are indicative of both the presence of the low lubricant level condition and the approach of this condition.

In accordance with yet another feature of the present invention, the control system includes means for sensing an engine overheat condition, and means for reducing the speed of the engine in response to the detection of the overheat condition.

Additional advantages and features of the present invention will become apparent from a reading of the detailed description of the preferred embodiments which makes reference to the following set of drawings in which:

DETAILED DESCRIPTION OF THE PREFERRED EMBODIMENTS

Figure 1:
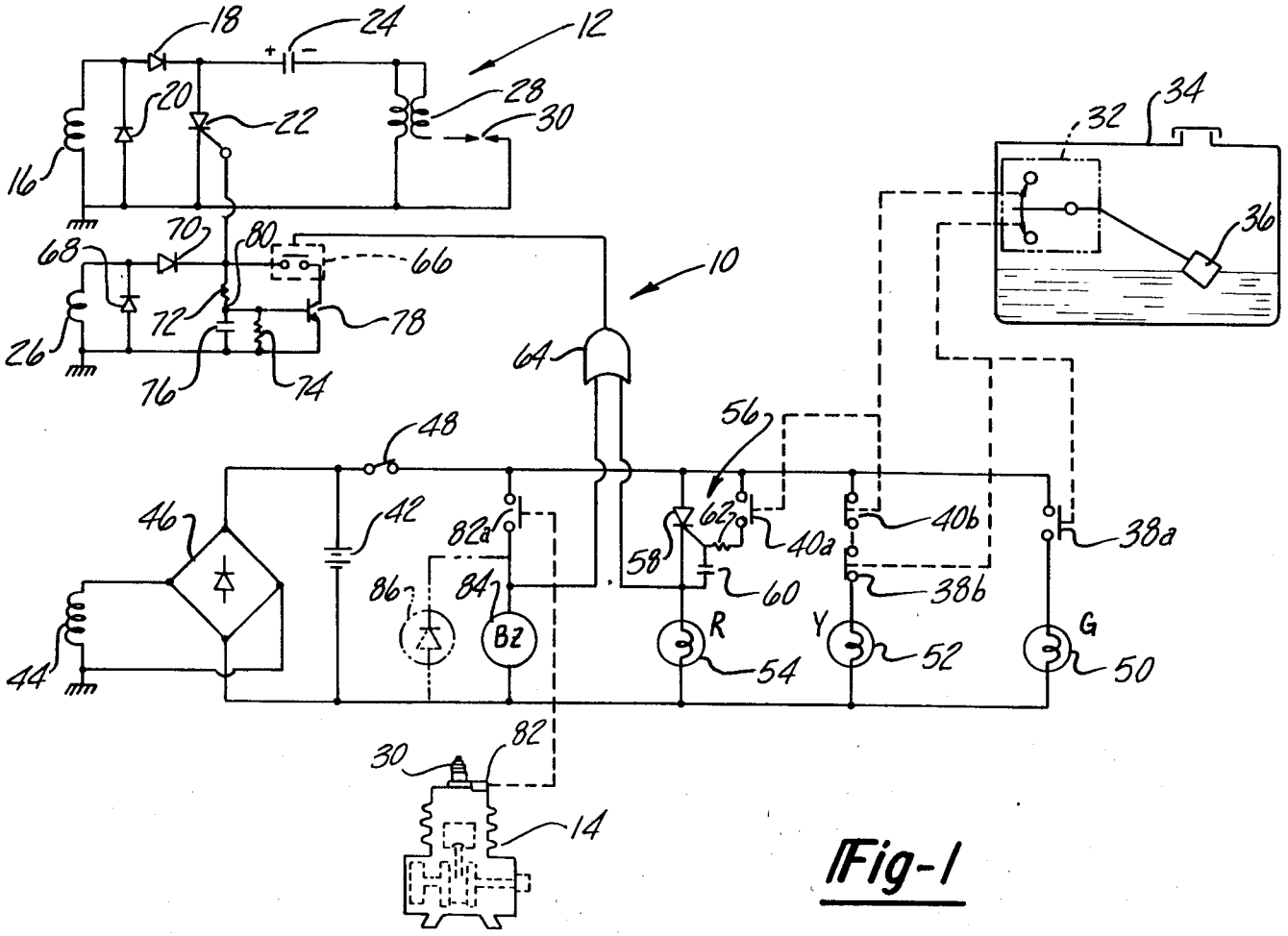
FIG. 1 is a schematic electrical diagram showing a first embodiment of an engine ignition and speed control system according to the present invention.

Referring to FIG. 1, a schematic diagram of a protection system 10 is shown to be connected to a capacitive discharge ignition system 12 of an internal combustion engine 14 according to the present invention. As will be appreciated from the description below, the protection system 10 is capable of selectively interrupting the operation of the ignition circuit 12, and thereby control the speed of the engine 14. The ignition circuit 12 includes a charging coil 16, rectifying diodes 18 and 20, a silicon controlled rectifier (SCR) 22, a capacitor 24, a pulser coil 26, and an ignition coil 28. The secondary winding of the ignition coil 28 is connected to a spark plug 30 of the engine 14.

Under normal engine running conditions, the charging coil 16 will charge the capacitor 24 in the polarity shown, and the capacitor 24 will remain charged until the pulser coil 26 generates a trigger signal sufficient to gate on the SCR 22. When the SCR 22 is gated on and rendered conductive, the capacitor 24 will rapidly discharge through the primary winding of the ignition coil 28. This rapid discharge will produce a sufficiently high voltage potential in the secondary winding of the ignition coil 28 to cause the spark plug 30 to spark and ignite the fuel mixture in the combustion chamber of the engine 14.

The protection system 10 includes a lubricant level detector switch 42 which is suitably mounted in a lubricant (e.g. oil) storage tank or reservoir 34. The lubricant level detector switch 32 includes a float arm 36 which is adapted to pivot in response to the lubricant level in the tank 34. The lubricant level detector switch 32 includes a first set of switch contacts 38*a* and 38*b* and a second set of switch contacts 40*a* and 40*b*. In the embodiment shown in FIG. 1, switch contacts 38*a* and 40*a* are normally open, while switch contacts 38*b* and 40*b* are normally closed.

When the lubricant level in the tank 34 is high, the float arm 36 of the lubricant level detector switch 32 will articulate to close switch contact 38*a* and open switch contact 38*b*. When the lubricant level in the tank 34 reaches a predetermined low level, the pivoting of the float arm 36 will close the switch contact 40*a* and open the switch contact 40*b*. In a lubricant level range between the high and predetermined low lubricant levels, the switch contacts 38*a* and 40*a* will be their normally open positions, and the switch contacts 38*b* and 40*b* will be in their normally closed position. The predetermined low lubricant level generally represents a lubricant level at which it is undesirable to maintain the engine 14 running at a high speed. Thus, it is desirable when the predetermined low lubricant level is reached for the operator to replenish the lubricant supply in the tank 34.

The protection system 10 includes a power supply which may be, for example, a battery 42, and means for recharging the battery, such as a generating coil 44 and a diode bridge rectifier 46 connected across the terminals of the battery. The generating oil may conveniently form part of a magneto generator assembly with the charge oil 16 and the pulser coil 26. The protection system 10 also includes a main switch 48 which in the embodiment shown is connected generally to one end of the battery 42 The main switch 48 controls the supply of electrical power to the circuitry of the protection system. However, it should be understood that the particular placement of the main switch 48 in the protection system circuit shown in FIG. 1 is intended to be exemplary only, and that other suitable placements for the main switch may be provided in other suitable applications for the present invention.

The circuitry for the protection system 10 includes a green lamp 50, a yellow cautionary lamp 52, and a red warning lamp 54 which are each connected in separate parallel legs of the protection system circuit. These parallel circuit legs are in turn generally connected across the battery 42 when the main switch 48 is in a closed position.

The switch contact 38*a* is connected in series with the green lamp 50, so that when the lubricant level in the tank 34 is high and the switch contact 38*a* is closed, then the green lamp will turn on from the power supplied by the battery 42. The green lamp 50 provides a visually perceptible output which will indicate to the operator that the lubricant level in the tank 34 is generally high. It should be appreciated that when both the main switch 48 and the switch contact 38*a* are closed, a series circuit loop is provided by the battery 42, the main switch 48, the switch contact 38*a*, and the green lamp 50.

The yellow cautionary lamp 52 is connected electrically in series with both the switch contacts 38*b* and 40*b*. Accordingly, when both the switch contacts 38*b* and 40*b* are closed, the yellow cautionary lamp 52 will turn on, and indicate to the operator that while there is still a sufficient supply of lubricant in the tank 34, the lubricant supply will need to be replenished within a reasonable time to maintain a high operating speed for the engine 14. Therefore, the yellow cautionary lamp 52 indicates the approach of a low lubricant level condition. It should be appreciated that when the switch contact 38*b* closes, the switch contact 38*a* will be opened and the green lamp will be turned off. Similarly, when the switch contact 38*b* is closed, the switch contact 40*a* will be open and the red warning lamp 54 will remain off.

The red warning lamp 54 is connected in series with a self-holding circuit generally designated by the reference numeral 56. The self-holding circuit 56 includes an SCR 58, a capacitor 60 connected across the gate and cathode of the SCR, and a resistor 62 connected between the gate of the SCR and the switch contact 40*a*. When the switch contact 40*a* closes at the point where the predetermined low lubricant level has been reached, the SCR will be gated on through the resistor 62 to light the red warning lamp 54. It should be noted that the capacitor 60 and the resistor 62 combine to cause a short delay between the time at which the switch contact 40*a* closes and the time in which the SCR 58 is turned on or rendered conductive. The red warning lamp 54 provides a visually perceptible output to the operator which will indicate that the lubricant in the tank 34 must be replenished.

When the SCR 58 conducts, a speed reduction signal is sent by an "OR" gate 64 to a switch 66 which will close in response to this signal. The switch 66 is connected to an override circuit portion of the protectioon system 10 which interconnects the pulser coil 26 with the gate of the SCR 22. This circuitry includes a diode 68 connected across the pulser coil 26, a diode 70 connected between one end of the pulser coil 26 and the gate of the SCR 22, resistors 72 and 74, a capacitor 76, and a transistor 78. The resistor 72 and the capacitor 76 are connected in series across the gate of the SCR 22 and ground. The base of the transistor 78 is connected at a circuit junction 80 between the resistor 72 and the capacitor 76, the collector terminal of the transistor is connected to one side of the switch 66, and the emitter of the transistor is connected to ground. The other end of the switch 66 is connected to the gate of the SCR 22. The resistor 74 is connected across the capacitor 76 with one end being connected to the circuit junction 80.

When the switch 66 is closed by the speed reduction signal, the transistor 78 will be permitted to conduct when the base terminal of the transistor reaches the threshold level of the transistor. With the engine 14 rotating at a high speed, trigger signals from the pulser coil 26 will charge the capacitor 76 to a sufficient potential that the transistor will turn on. This will create a shunt path to ground for the trigger signals from the pulser coil 26 through the transistor 78 which will prevent the pulse signals from gating on the SCR 22. Accordingly, during this time, the capacitor 26 in the ignition circuit 12 will be prevented from discharging and the engine 14 will misfire. Such misfiring will cause the speed of the engine 14 to gradually decrease to a predetermined point which is controlled by the respective component values for the resistors 72 and 74, and the capacitor 76.

This misfiring condition can also be caused by an overheat signal produced by a temperature sensor 72 which is suitably secured to the engine 14. This overheat signal will cause a switch contact 82*a* to close. When switch contact 82*a* closes, an electrical series loop is created with a buzzer 84 and the battery 42 which will cause an audibly perceptible output indicative of the overheat condition. It should be noted that a light emitting diode (LED) 86 may also be provided in the place of the buzzer or in addition thereto via a parallel electrical connection across the buzzer 84 to provide a visually perceptible output of the overheat condition.

When the switch contact 82*a* closes, a speed reduction signal will be transmitted through the OR gate 64 to the switch 66 to initiate a misfiring condition if the speed of the engine 14 is currently greater than the predetermined low speed level. Thus, it will be appreciated that the OR gate 64 permits for two separate speed reduction signals to be generated by the protection system 10, one of which being in response to a low lubricant level condition, and the other being in response to an overheat condition. Accordingly, the OR gate has two inputs of which one is connected to the circuit junction between the switch contact 82*a* and the buzzer 84, and the other of which is connected to the circuit junction between the red lamp 54 and the cathode of the SCR 58.

It is important to note that once the speed reduction signal is generated by the low lubricant level condition, it will be maintained even though the lubricant supply of tank 34 is replenished. This function is provided by the self-holding circuit 56, since the SCR 58 will remain on even after the gate signal is removed. Thus, when the lubricant in the tank 34 is replenished and the lubricant level detector 34 causes the switch contact 40*a* to open, the SCR 58 will remain in a conducting condition. The SCR 58 can only be turned off when the operator manually opens the main switch 48 to remove the source of electrical power or current flow through the SCR 58. Accordingly, it will be appreciated that the unique combination of circuit components in the protection system 10 will prevent an unintended termination of the misfiring condition when the lubricant tank 34 is being replenished.

It should also be noted that while the engine 14 is shown in FIG. 1 to be a single cylinder engine, the principles of the present invention are also applicable to multicylinder engines. Similarly, even though the present invention is particularly advantageous in connection with outboard motor engines equipped with capacitive discharge ignition systems, it should be understood that the present invention may be used with other types of engines and ignition systems. Additionally, in an outboard motor application, the storage tank 34 may be mounted directly on the engine or located remotely from the engine. Furthermore, it should be appreciated that the transistor 78 and the SCR 58 may be replaced by other suitable controlled conduction devices which can perform the same function as these circuit components.

Figure 2:
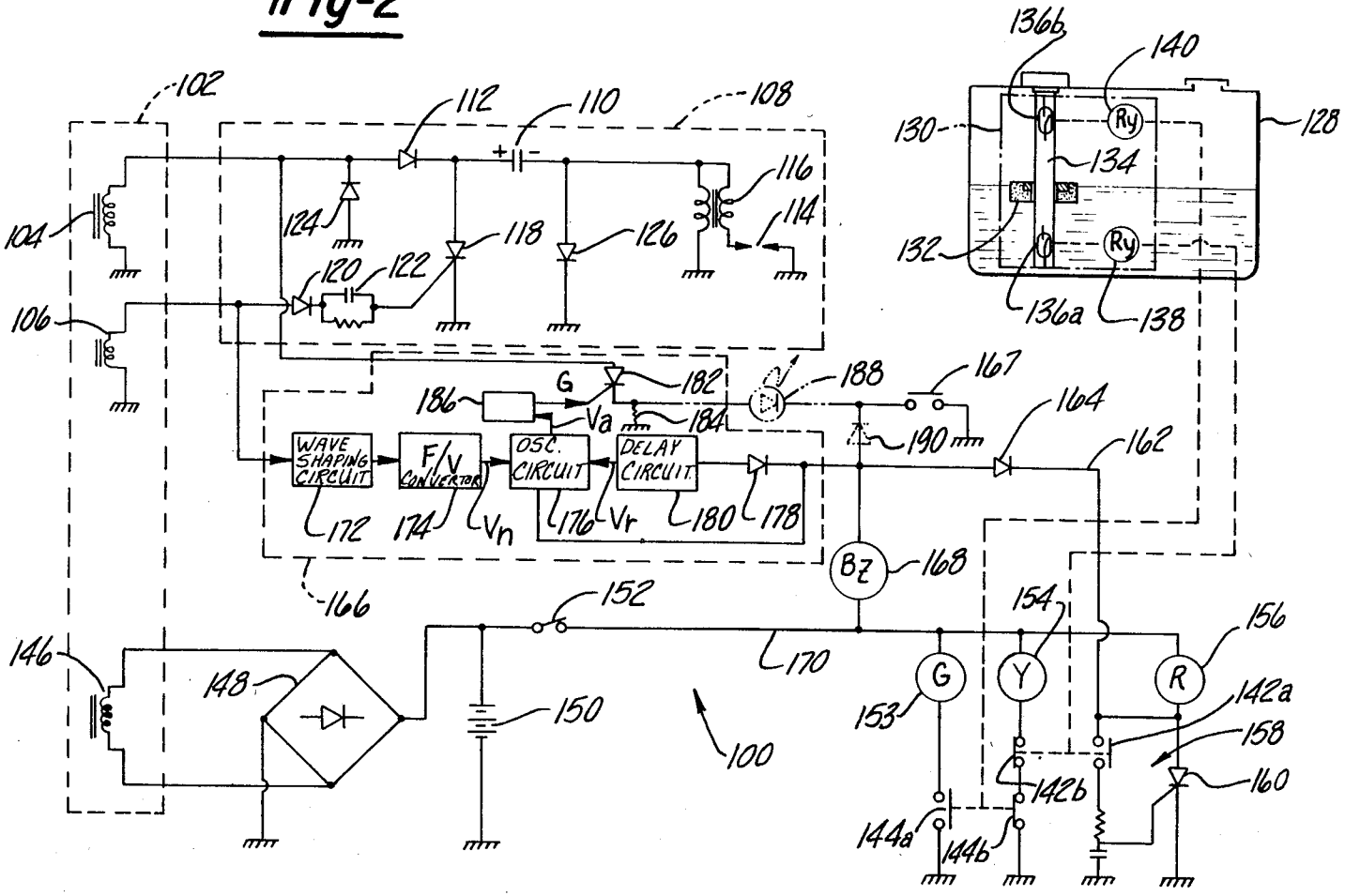
FIG. 2 is a schematic electrical diagram showing a second embodiment of an engine ignition and speed control system according to the present invention.

Referring to FIG. 2, a second embodiment of a protection system 100 according to the present invention is shown. A magneto generator is generally designated by the reference numeral 102. The magneto generator 102 includes a charging coil 104 and a pulser coil 106. The charging coil 104 and pulser coil 106 provide their signals and charges to a CD ignition circuit, indicated generally by the reference numeral 108.

The CDI circuit 108 includes a charging capacitor 110 that is charged from the charging coil 104 through a rectifying diode 112 to a polarity as shown in FIG. 2. A charge will be built up on the capacitor 110 during rotation of the engine crankshaft until an appropriate tripping device such as a rotating magnet causes a voltage to be generated in the pulser coil 106 to indicate that the crankshaft is in the appropriate position to demand firing of a spark plug 114. Of course, there will be one spark plug for each cylinder of the engine and the circuit shown in FIG. 2 is that associated with only a single cylinder of the engine. It should be understood that there will be corresponding circuits for each of the spark plugs of a multi-cylinder engine. However, it should also be understood that other ignition circuits than that illustrated may be used in conjunction with the invention.

The spark plug 114 is in circuit with a secondary winding of an ignition coil 116. The primary winding of the coil 116 is in circuit with the charging capacitor 110 and is adapted to be discharged to ground through an SCR 118 under the control of a circuit energized by the pulser coil 106. A trigger signal from the pulser coil 106 is transmitted through a diode 120 and capacitor resistor circuit 122 to the gate of the SCR 118 so as to turn it on and cause the capacitor 110 to discharge. This discharge through the primary winding of the ignition coil 110 will cause a voltage to be induced in the secondary winding which will fire the spark plug 114 in a known manner. A diode 124 is placed between ground and the connection of the coil 104 to the diode 112 for providing a circuit during the negative half wave of the charging coil 104. A similar diode 126 is provided between the capacitor 110 and the primary of the ignition coil 116 and ground. This portion of the ignition system may be considered to be generally conventional and forms no part of the invention.

The lubricant storage tank 128 of this embodiment includes a sensing device 130 for determining the level or amount of lubricant in the tank. The sensing device 130 includes a magnetic float 132 which reciprocates along a vertical column 134 in response to the level of lubricant in the tank 126. The column 134 includes two reed switches 136*a* and 136*b* which actuate in response to the proximity of the magnetic float 132. The actuation of the reed switch 136*a* controls a relay 138, while the actuation of the reed switch 136*b* controls a relay 140. The relay 138 is provided with switch contacts 142*a* and 142*b*, while the relay 140 is provided with switch contacts 144*a* and 144*b*.

Similar to the circuit construction of FIG. 1, the protection system 100 includes a generating coil 146, a diode rectifier bridge 148, a battery 150, a main switch 152, a green lamp 153, a yellow lamp 154, a red lamp 156, and a self-holding circuit 158 which includes an SCR 160. However, in contrast to FIG. 1, it should be noted that in the protection system 100 of FIG. 2, the connections to the diode rectifier bridge 148 are now such that each of the parallel circuit legs containing the green, yellow and red lamps are connected at one end thereof to ground.

Briefly, in operation, it will be seen that when the lubricant level in the tank 136 is that as shown in FIG. 2, the switch contacts 142*b* and 144*b* will be closed, while the switch contacts 142*a* and 144*a* will be open. Accordingly, the yellow lamp 154 will turn on from the power supplied by the battery 150. If the lubricant supply in the tank 126 is replenished, then the red switch 136*b* will actuate and cause the relay 140 to close the switch contact 144*a* and open the switch contact 146*b*. This will turn on the green lamp 153, while turning off the yellow lamp. However, if the lubricant level continues to decrease to the predetermined low lubricant level, than the reed switch 136*a* will actuate and cause the relay 138 to close the switch contact 142*a* and open the switch contact 142*b*. This will turn off the yellow lamp 154 and turn on the red lamp 156 upon the conduction of the SCR 160.

When the SCR 160 conducts a speed reduction signal will be produced on a conductor 162 having a connection to the anode of the SCR 160. This speed reduction signal is transmitted through a diode 164 to an engine speed control circuit 166. As in protection system of FIG. 1, the protection system 100 of FIG. 2 will also produce a speed reduction signal in response to the overheat condition. The switch contact 167 will close in response to the overheat condition and cause a buzzer 168 connected between conductors 162 and 170 to produce an audibly perceptible output indicative of the overheat condition.

In response to the speed reduction signal, the engine speed control circuit 166 is effective to cause the spark plug 114 not to be fired for increasing time intervals during a given period of time so that the spark plug 114 will only fire once every several revolutions of the engine until the speed is reduced to a level wherein the consumption of lubricant will be substantially reduced. The engine speed control circuit 166 includes a wave form shaping circuit 172 that receives the outputs from the pulser coil 106 and generates a square wave form pulse from them. This pulse is transmitted to a frequency to voltage converter 174 that provides an output voltage $V_n$ that is indicative of the engine speed. When the speed reduction signal is present on conductor 162, an input will also be provided to an oscillation circuit 176 which receives an input from the frequency to voltage converter 174 in the form of the signal $V_n$.

Figure 3:
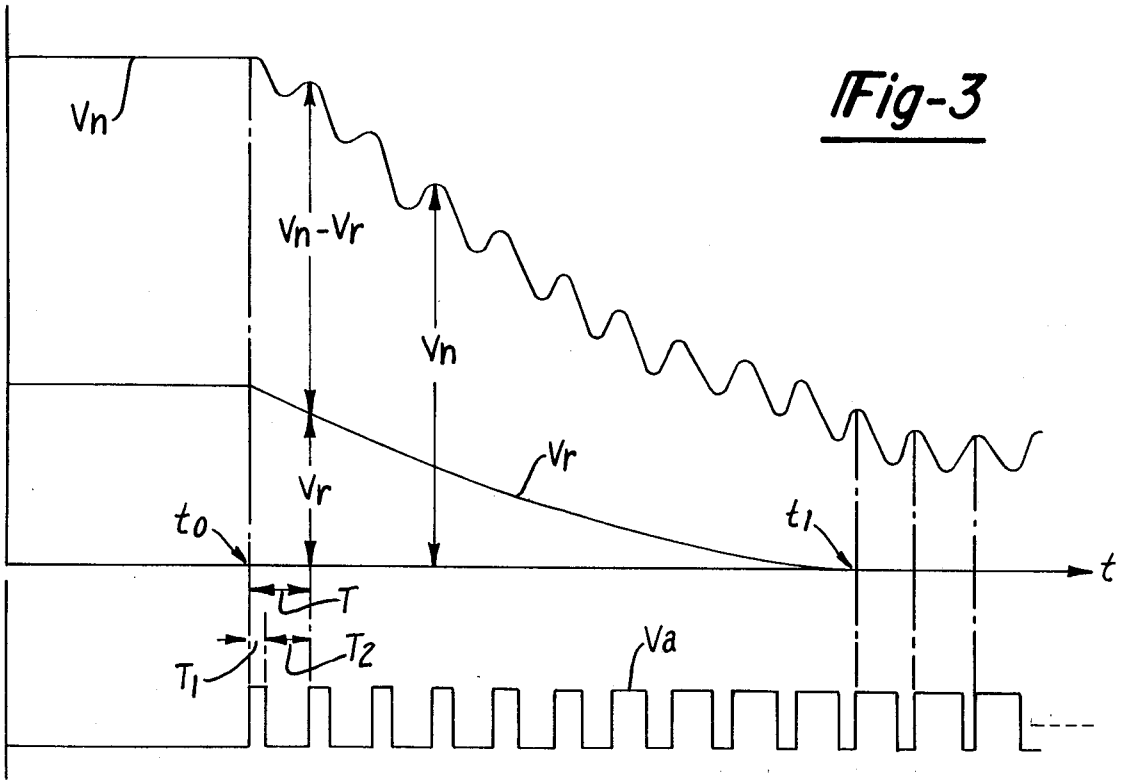
FIG. 3 is a diagrammatic representation explaining the operation of the embodiment of FIG. 2.

The speed reduction signal also causes power to be delivered through a diode 178 to a delay circuit 180 which has an output $V_r$ that is also delivered to the oscillator circuit 176. The time delay circuit 180 operates like a capacitor in that its output signal $V_r$ decays along a curve as shown in FIG. 3.

The oscillator circuit 176 has an output voltage $V_a$ that is generated for a time period which is varied in accordance with the difference between the voltages $V_n$ and $V_r$. The output of the oscillator circuit 176 is shown on the bottom line curve of FIG. 6 wherein the output extends for a period $T_1$ during a preset time interval T. As may be seen from this figure, the time $T_1$ continues to increase until the voltage $V_r$ has decayed to the point $T_1$ at which it is constant for a fairly substantial time period. During the time $T_1$ when the oscillator 176 is providing its high output, the firing of the spark plug 114 will be disabled.

This disabling is achieved by providing a shunting circuit that prevents charging of the capacitor 110. This shunting circuit includes an SCR 182 that has its output connected to ground via a resistor 184. The SCR 182 has its gate controlled by a gate circuit 186 that receives the output from the oscillator circuit 176 and which energizes the gate of the SCR 182 for a time $T_1$ as set by the oscillator circuit 176. An LED 188 and a diode 190 may also be included to provide a flashing indication that the ignition is being disabled to reduce the engine speed.

It should be noted that the time $T_1$ is effective to stop firing of the spark plug 114 for a given time interval during a given time period. Hence, the spark plug 114 will not fire for each revolution of the engine and the engine speed will, accordingly, be reduced so as to reduce the consumption of lubricant from the tank 126.

Figure 4:
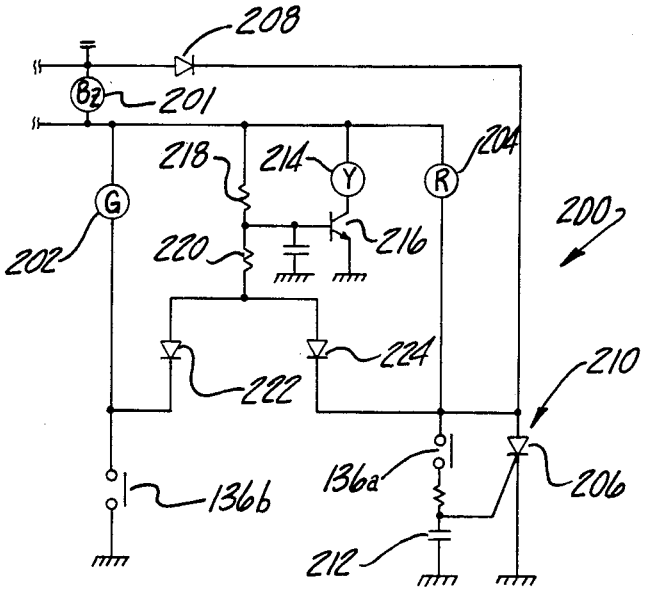
FIGS. 4 and 5 are schematic electrical diagrams showing further embodiments according to the present invention.

Referring now to FIG. 4, a schematic diagram of a portion of third embodiment of a protection system 200 according to the present invention is shown. The remainder of the protection system 200 may be similar to the circuitry for the protection system 100 shown in FIG. 2. It should be noted however that the protection system 200 is adapted to operate directly from the reed switches 136*a* and 136*b* shown in FIG. 2. The protection system 200 also includes a buzzer 201 to provide an audibly perceptible output indicative of the presence of an overheat condition.

When the reed switch 136*b* is closed, a green lamp 202 will be turned on. Similarly, when the reed switch 136*a* is closed, a red lamp 204 will be turned on. The closing of the reed switch 136*a* will also cause an SCR 206 to be gated on. This will produce a speed reduction signal which will be transmitted through a diode 208. In this embodiment, the self-holding circuit 200 includes the SCR 206, and a capacitor 212.

When both of the reed switches 136*a* and 136*b* are open, a yellow lamp 214 will turn on. The yellow lamp 214 is connected to the collector terminal of a transistor 216 which will be rendered conductive to permit current to flow through the yellow lamp at this time. The conduction of the transistor 216 is controlled by the voltage dividing resistors 218 and 220.

When the green lamp 202 is turned on, the diode 222 provides a current path which will maintain the voltage at the base of the transistor 216 at a level below its threshold turn on point. Similarly, during the time that the red lamp 204 is on, the diode 224 provides a current path which will maintain the voltage at the base of the transistor at a level below its threshold turning on point.

Figure 5:
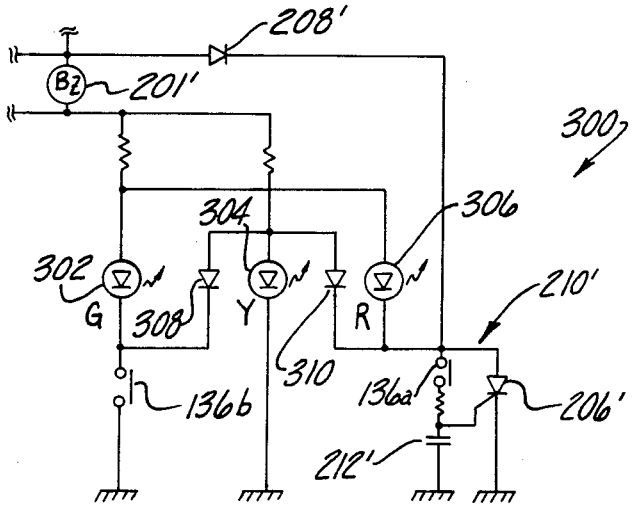

Referring to FIG. 5, a schematic diagram of a portion of a protection system 300 according to the present invention is shown. Since the protection system 300 of FIG. 5 is similar in construction and operation to the protection system 200 of FIG. 4, all corresponding circuit components will be identified with the same reference numerals primed. The principle difference between these two protection systems is that the protection system 200 employs LEDs instead of lamps. Accordingly, the protection system 300 is provided with a green LED 302, a yellow LED 304, and a red LED 306. It should also be noted that the protection system 300 does not require a transistor corresponding to the transistor 216 of FIG. 4. Rather, a diode 308 provides a shunt path to ground out the yellow LED 304 when the green LED 302 is turned on, and the diode 310 provides a shunt path to ground out the yellow LED 304 when the red LED 306 is turned on.

The various embodiments which have been set forth above were for the purpose of illustration and were not intended to limit the invention. It will be appreciated by those skilled in the art that various changes and modifications may be made to these embodiments described in this specification without departing from the spirit and scope of the invention as defined by the appended claims.

I claim:

1. A control system for an internal combustion engine, comprising:

means for detecting a predetermined condition;

means for controlling a predetermined operating parameter of said engine in response to the detection of said predetermined condition;

means for manually terminating said control of said predetermined operating parameter of said engine; and means for maintaining said control of said predetermined operating parameter of said engine after said predetermined condition has ceased until said control is manually terminated.

2. The control system according to claim 1, wherein said predetermined condition is a low lubricant level condition.

3. The control system according to claim 2, wherein said predetermined operating parameter of said engine is the speed of said engine.

4. The control system according to claim 3, wherein said controlling means includes means for reducing the speed of said engine to a predetermined low level, even though the throttle of said engine is set for a higher speed.

5. The control system according to claim 4, also including means for producing a perceptible output indicative of said low lubricant level condition.

6. The control system according to claim 5, further including means for producing a perceptible output indicative of the approach of said low lubricant level condition.

7. The control system according to claim 2, also including means for detecting a second predetermined condition, and means for controlling said predetermined operating parameter of said engine in response to the detection of said second predetermined condition.

8. The control system according to claim 7, wherein said second predetermined condition is an overheat condition, and said predetermined operating parameter of said engine is the speed of said engine.

9. The control system according to claim 8, wherein said means for controlling the speed of said engine in response to the detection of said overheat condition does not require manual termination.

10. The control system according to claim 9, further including means for producing a perceptible output indicative of said overheat condition.

11. In a two-cycle engine outboard motor, a protection system comprising:

means for detecting a condition which is undesirable for high speed operation;

means for reducing the speed of said outboard motor in response to the detection of said condition;

means for manually disabling said speed reducing means; and means for precluding the resumption of the previous engine speed when said condition is no longer present until said manually disabling means is actuated.

12. The invention according to claim 11, wherein said manually disabling means is a switch which connects said protection system to a source of electrical power.

13. The invention according to claim 12, wherein said condition is a low lubricant level condition.

14. The invention according to claim 13, wherein said reducing means includes means for reducing the speed of said outboard motor at a controlled rate to a predetermined low speed level.

15. A protection system for a two-cycle engine having a separate lubricant reservoir, a throttle control, and an ignition system, comprising:

sensing means associated with said lubricant reservoir for detecting a low lubricant level condition;

first circuit means for producing a speed reduction signal in response to the detection of said low lubricant level condition;

second circuit means for interrupting the operation of said ignition system so as to gradually reduce the speed of said engine in response to said speed reduction signal even though said throttle control may be set for a higher speed; and switch means operatively associated with said first circuit means for manually terminating said speed reduction signal;

said first circuit means including controlled conduction means for maintaining the presence of said speed reduction signal after said low lubricant level condition is no longer present until the actuation of said switch means.

16. The protection system according to claim 15, wherein said controlled conduction means is a silicon controlled rectifier which is gated on in response to the detection of said low lubricant level condition.

17. The protection system according to claim 16, wherein said switch means is operatively associated with said first circuit means such that upon actuation said switch means will render said silicon controlled rectifier non-conductive.

18. The protection system according to claim 15, wherein said second circuit means includes a speed setting circuit which is responsive to a trigger signal produced by said ignition system for controlling the interruption of the operation of said ignition signal.

19. The protection system according to claim 15, wherein said first circuit means includes means for producing perceptible outputs indicative of both the presence of said low lubricant level condition and the approach of said low lubricant level condition.

20. The protection system according to claim 15, including second sensing means for detecting an overheat condition, and third circuit means operatively associated with said second circuit means for producing said speed reduction signal in response to the detection of said overheat condition.

* * * * *